US006604976B2

(12) United States Patent
Lenkoff

(10) Patent No.: US 6,604,976 B2
(45) Date of Patent: Aug. 12, 2003

(54) SEGMENTAL TOY GAME

(75) Inventor: Roger Lenkoff, Louisville, KY (US)

(73) Assignee: Stry-Lenkoff, Louisville, KY (US)

( * ) Notice: Subject to any disclaimer, the term of this patent is extended or adjusted under 35 U.S.C. 154(b) by 0 days.

(21) Appl. No.: 09/737,100

(22) Filed: Dec. 14, 2000

(65) Prior Publication Data

US 2002/0077017 A1 Jun. 20, 2002

(51) Int. Cl.[7] ..... A63H 3/00; A63H 3/08; A63H 33/26

(52) U.S. Cl. ..... 446/73; 446/98; 446/139

(58) Field of Search ..... 446/72, 73, 75, 446/80, 89, 387, 388, 901, 129–139, 147, 148, 149, 150; 434/428, 433, 168, 190, 258, 87, 88, 429, 84, 81; 40/600, 621, 594, 595, 725, 726, 721, 661.01, 723, 724; 273/443, 447, 421, 456; 206/765, 767, 752, 575, 579, 471–467, 470; 402/70–73

(56) References Cited

U.S. PATENT DOCUMENTS

| | | | | |
|---|---|---|---|---|
| 1,879,002 | A | | 9/1932 | Alles |
| 3,093,919 | A | | 6/1963 | Holtz |
| 3,316,669 | A | | 5/1967 | Nachbar |
| 3,851,885 | A | * | 12/1974 | Pepkowski et al. ..... 273/287 |
| 4,030,736 | A | * | 6/1977 | Petrusek ..... 273/348.3 |
| 4,165,579 | A | | 8/1979 | Chase |
| 4,702,700 | A | | 10/1987 | Taylor |
| 4,830,181 | A | * | 5/1989 | Hartman ..... 206/301 |
| 4,846,689 | A | | 7/1989 | Day |
| 4,952,153 | A | * | 8/1990 | McAllister ..... 434/168 |
| 5,014,850 | A | * | 5/1991 | Huff ..... 206/1.7 |
| 5,161,907 | A | * | 11/1992 | Byrne ..... 206/387.13 |
| 5,178,573 | A | | 1/1993 | Smith |
| 5,478,085 | A | * | 12/1995 | Canner et al. ..... 273/239 |
| 5,666,712 | A | * | 9/1997 | Cvetkov ..... 29/458 |
| 5,820,383 | A | * | 10/1998 | Levins ..... 273/157 R |
| 5,979,895 | A | * | 11/1999 | Dove ..... 273/157 R |
| 6,022,259 | A | * | 2/2000 | Rudawsky et al. ..... 446/488 |
| 6,045,161 | A | * | 4/2000 | Ashcraft et al. ..... 281/31 |
| 6,056,549 | A | * | 5/2000 | Fletcher ..... 283/46 |
| 6,170,666 | B1 | * | 1/2001 | DesLauriers ..... 206/467 |
| 6,182,830 | B1 | * | 2/2001 | Au et al. ..... 206/6.1 |
| 6,247,729 | B1 | * | 6/2001 | Kaufman ..... 281/22 |

* cited by examiner

*Primary Examiner*—Derris H. Banks
*Assistant Examiner*—Faye Francis
(74) *Attorney, Agent, or Firm*—Polster, Lieder, Woodruff & Lucchesi

(57) ABSTRACT

A toy game wherein a unique casing includes hinged top and bottom lids shaped to store and provide nesting and securing cradles for a plurality of sheets some of which include overall visual images and others of which include push-out segments to be fastened to the overall visual images.

17 Claims, 9 Drawing Sheets

SEGMENTAL TOY GAME

BACKGROUND OF THE INVENTION

The present invention relates to a game arrangement and more particularly to a new and novel toy game assembly requiring skill and observation, including a unique casing which can be readily opened with enhanced game usage and closed in an efficiently organized manner. More particularly, the present invention provides a variety of moveable fastenable segments which can be selectively fastened on and in a casing defining overall image framework, the novel structure serving to provide a unique amusement, skill and educational game.

It has long been known to utilize moveable magnetic marker segments for assembly on a magnetically responsive surface to produce a desired image. Attention is directed to U.S. Pat. No. 1,879,002, issued to C. C. Alles on Sep. 27, 1932, which discloses an overall musical scale image and permanent magnetic segments in the form of musical notes which can be fastened in selective order on such overall musical scale image. In U.S. Pat. No. 3,093,919, issued to H. J. Holtz on Jun. 18, 1963, a magnetic display arrangement, including a flexible magnetically responsive display sheet and magnetic markers is disclosed. In the three U.S. Pat.; namely, No. 3,316,669, issued on May 2, 1967 to E. G. Nachbar; U.S. Pat. No. 4,165,579, issued on Aug. 28, 1979 to H. S. Chase; and, U.S. Pat. No. 4,702,700, issued on Oct. 27, 1987 to C. J. Taylor, toy game assemblies are disclosed, each of which includes storage arrangements for game parts, with U.S. Pat. No. 3,316,669 teaching adhesive segments which utilizes hooked and looped tape material for segment fastening and U.S. Pat. No. 4,702,700, which teaches magnetic means for fastening. Finally, attention is directed to U.S. Pat. No. 4,846,689, issued on Jul. 11, 1989 to C. J. Day and U.S. Pat. No. 5,178,573, issued on Jan. 12, 1993, both of which patents disclose magnetically responsive overall doll images with magnetized doll garment segments which can be magnetically fastened to the overall doll images. Although the broad features of fastening moveable segments by both magnetic means and hook and loop means to overall visual images, as well as storage arrangements for the moveable segment parts, are broadly disclosed in the aforementioned patent structures, none—either alone or in combination—teaches, suggests or discloses the unique and novel assembly, which includes a casing arrangement herein described and which both serves to efficiently accommodate the several parts of a novel toy game for storage and which also enters into and promotes the usage of the toy game by presenting and securing a variety of overall alternative visual images—as well as presenting and securing the fastenable segments which are to be selectively fastened to one or more of such overall visual images.

Among the other features of the present invention, a unique and novel toy game arrangement is provided for both entertainment, skill, and educational usage. The toy game of the present invention is comparatively straight-forward efficient and economical in manufacture, assembly, usage and storage and concomitantly selectively provides variation and organization in assembly, operation, storage and usage with a minimum of operational parts and a minimum of usage steps.

Various other features of the present invention will become obvious to one skilled in the art upon reading the disclosure set forth herein.

SUMMARY OF THE INVENTION

More particularly, the present invention provides a toy game which comprises: an openable-closable casing, a portion of which casing incorporates and securely retains a variety of changeable overall visual alternatively usable overall images; and at least one moveable segment sized to be removably disposable in the openable-closable casing and configured to overlie at least a portion of a secured and retained, changeable, alternative overall visual image, the moveable segment including fastening material to be movably held in retained, fastened relation with one of the selected, alternative overall visual images.

It is to be understood that various changes can be made by one skilled in the art in the novel structural arrangement disclosed herein without departing from the scope or spirit of the present invention. For example, a fastenable receptive, alternative overall visual image sheet can be employed in the form of a skeletal human body and a segmental sheet of various fastenable human body parts, which are removable from the sheet can be employed to be selectively fastened to the overall visual human body image, thus providing both an educational and amusing game of skill.

BRIEF DESCRIPTION OF THE DRAWINGS

Referring to the drawings, which serve to disclose several unique and novel embodiments of the present invention.

DETAILED DESCRIPTION OF THE DRAWINGS

Figure 1A:
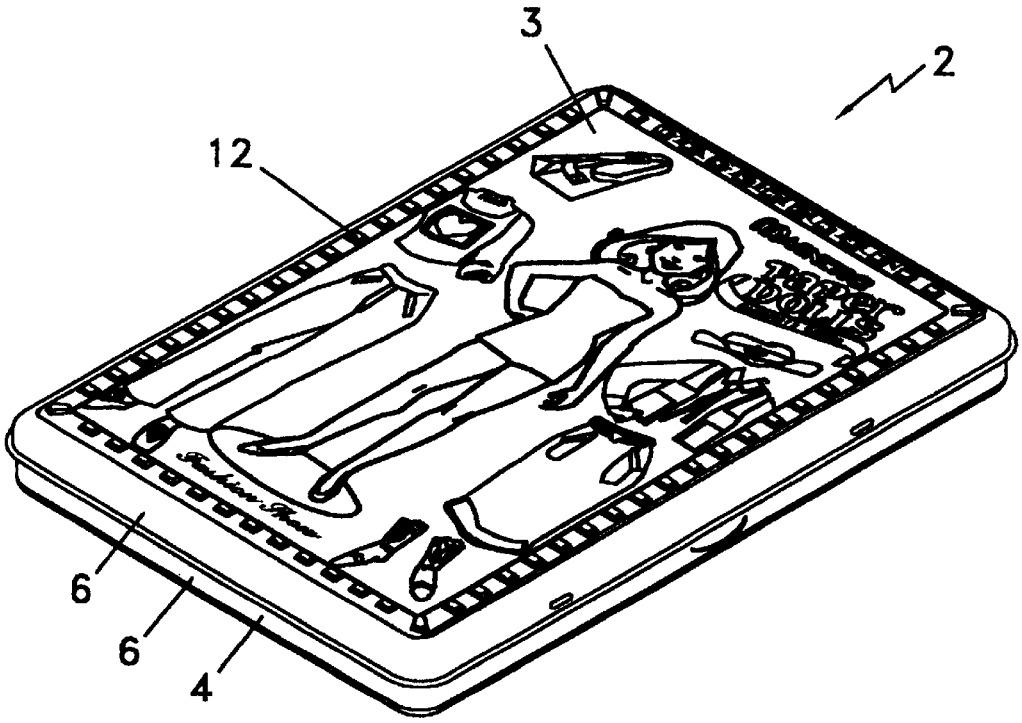
FIG. 1A is a top view of a novel openable—closable magnetically responsive casing in closed position with an overall visual image on the upper surface thereof, accompanied by segments of surrounding spaced visual clothing.
Figure 1B:
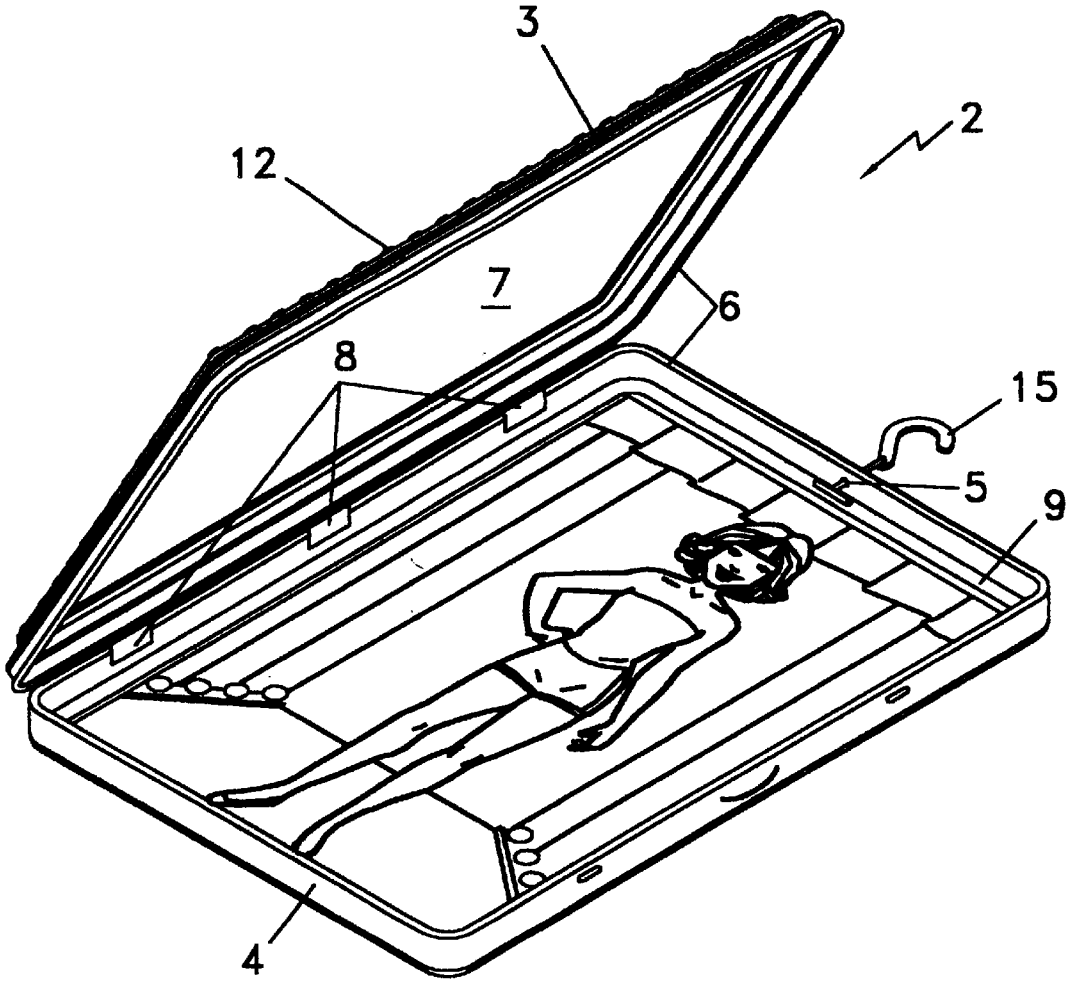
FIG. 1B is an isometric view of the novel openable-closable magnetically responsive casing of FIG. 1A in open casing position and disclosing an alternative overall visual image in the form of a doll.
Figure 2:
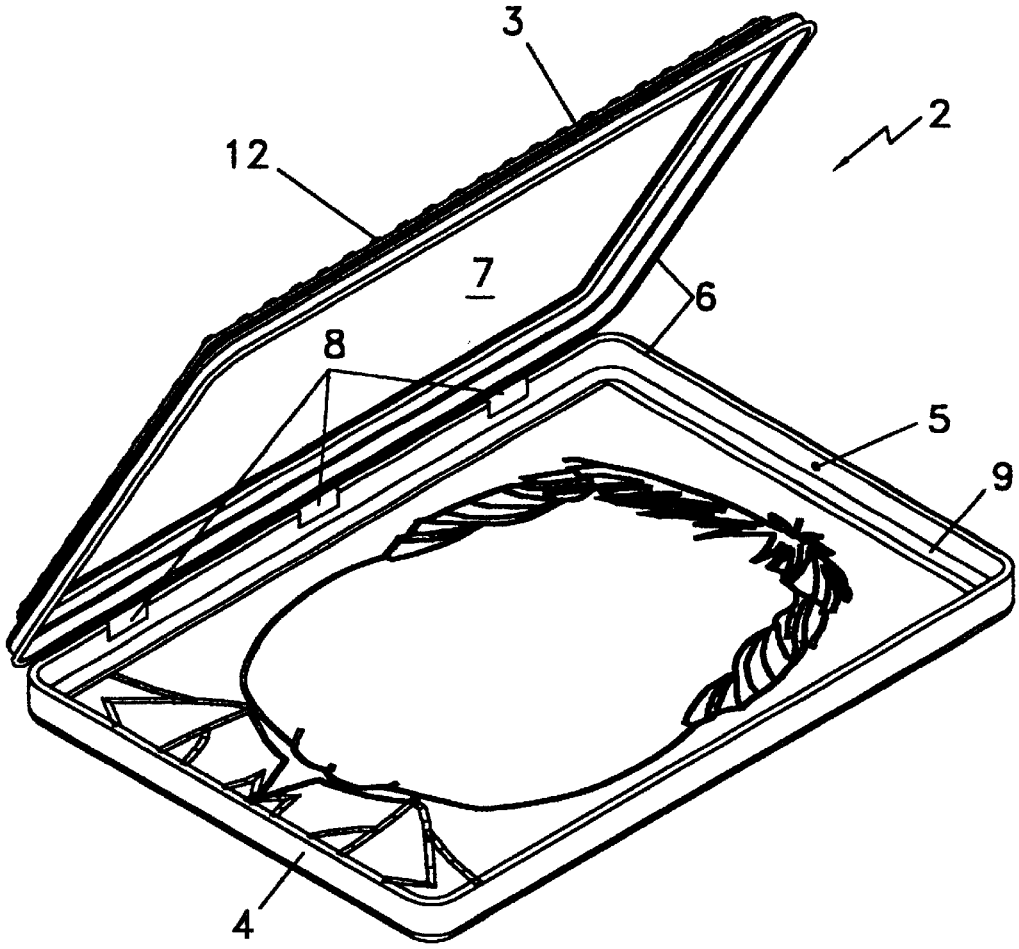
FIG. 2 is a similar isometric view of a casing like that of FIG. 1B disclosing in outline form an overall visual image of funny face design with accommodation form for ear, nose, eyebrow and mouth on the flat panel inner face of a bottom lid.

Referring to FIGS. 1A, 1B, and 2 of the drawings, each of these isometric views discloses a novel embodiment of the present invention, including the unique openable-closable casing 2, which in the disclosure herein can be configured to be in a longitudinally extending, flat rectangular form with rounded corners and similar in shape to the appearance of an artist's paint box.

In one advantageous embodiment of the present invention, casing 2 can be approximately dimensioned to have a length of approximately eight and one half (8½) inches, a width of approximately six (6) inches and a thickness of approximately seven eighths (⅞) inches, the thickness being a function of the number and thickness of sheets which are described hereinafter and which are to be included in a casing 2. It is to be understood that the present invention is not to be considered as limited to the aforedescribed configuration and dimension but that other shapes and sizes—such as oval or disc shape—can be utilized, depending upon the utilized art and the demands of the marketplace. The casing 2 of FIGS. 1 and 2 can be stamp formed from a suitably magnetic metallic material such as a tin composition of approximately thirty (30) millimeters thickness so as to readily permit the novel border stamping described herein, as well as the paint coating described herein.

Each casing 2 of FIGS. 1A, 1B, and 2 includes mating and snap together fully openable and fully closable top and bottom rectangular lids 3 and 4, respectively. These lids 3 and 4 serve to form nesting border forming cradles for the sheets described herein, which sheets can be cradled and stored in the casings 2 when not in use. Each top and bottom lid of the casing 2 includes mating perimeter pairs of spaced opposed peripheral side edges 6 which are integral with and extend normal to spaced, opposed flat rectangular shaped panel sections 7. It is to be noted that one short perimeter side edge 6 (advantageously, the lower edge 6) can be provided with a small aperture 5 (FIGS. 1B and 2) to receive a plastic hook 15 to suspend casing 2 from a marketing stand (not shown).

Figure 3:
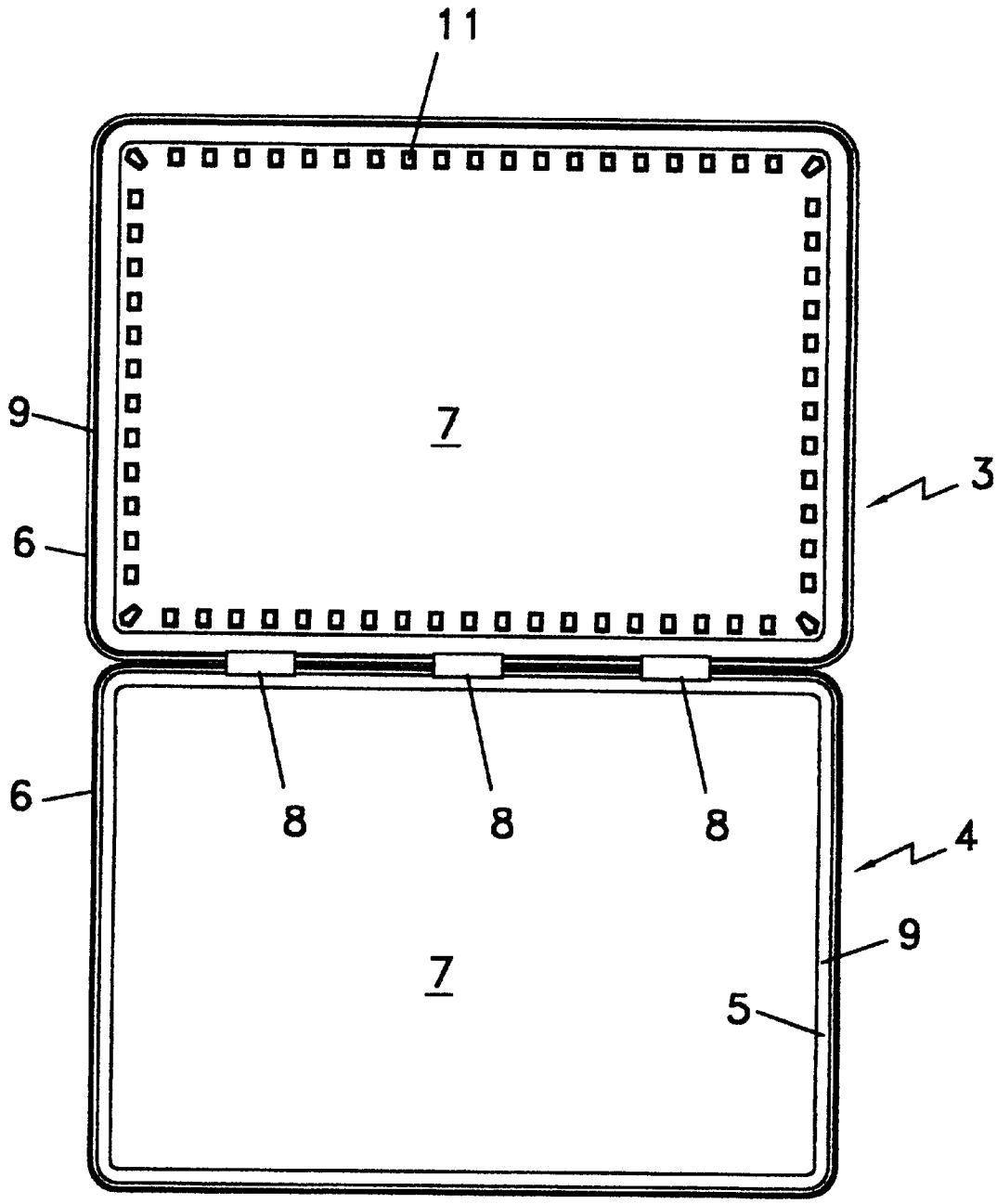
FIG. 3 is a fully opened, in the flat, hinged casing, disclosing the inner surfaces of the hinged top and bottom lids or cradles.
Figure 4A:
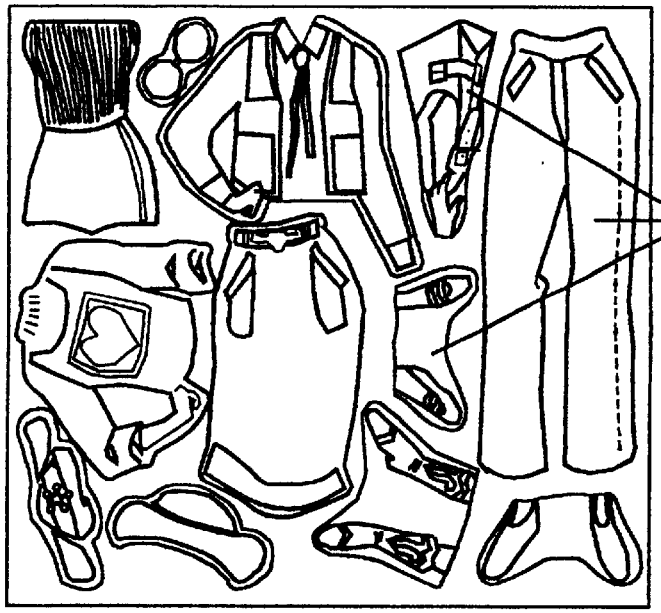
FIG. 4A is a flat, magnetically coated scored sheet of separable, push-out, coated, clothing segments, each segment corresponding with a portion of the overall doll image of FIG. 1.
Figure 4B:
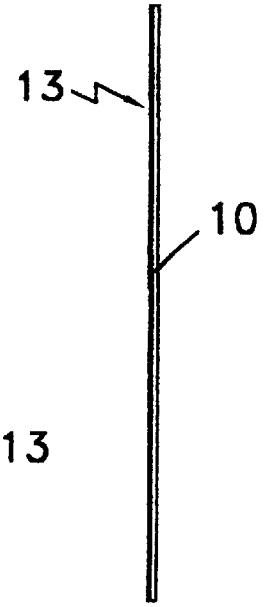
FIG. 4B is a side edge view of FIG. 4A.
Figure 5A:
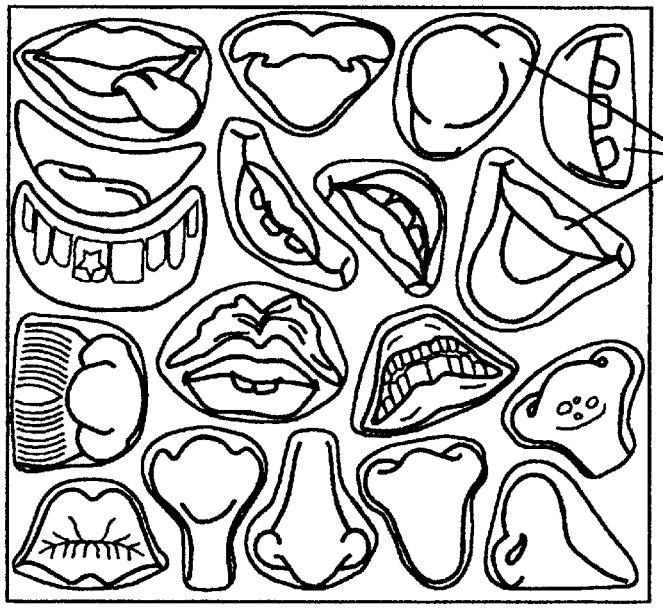
FIG. 5A is a flat, magnetically coated, scored sheet of separable push-out face segments including eyes, ears, noses and mouth segments corresponding with portions of the funny face images of FIG. 2.
Figure 5B:
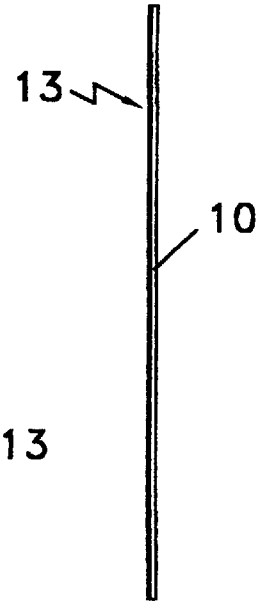
FIG. 5B is a side edge view of FIG. 5A.
Figure 6:
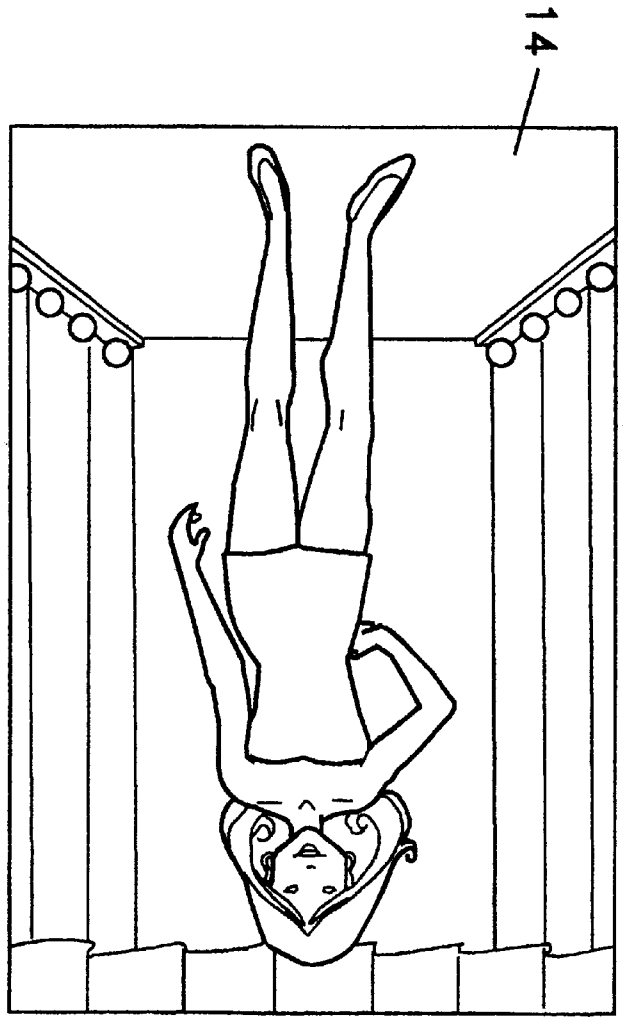
FIG. 6 is an overall, alternative image of a different play doll sheet which can be nested within a selected border frame in either of the casings of FIGS. 1A, 1B, and 2.
Figure 7:
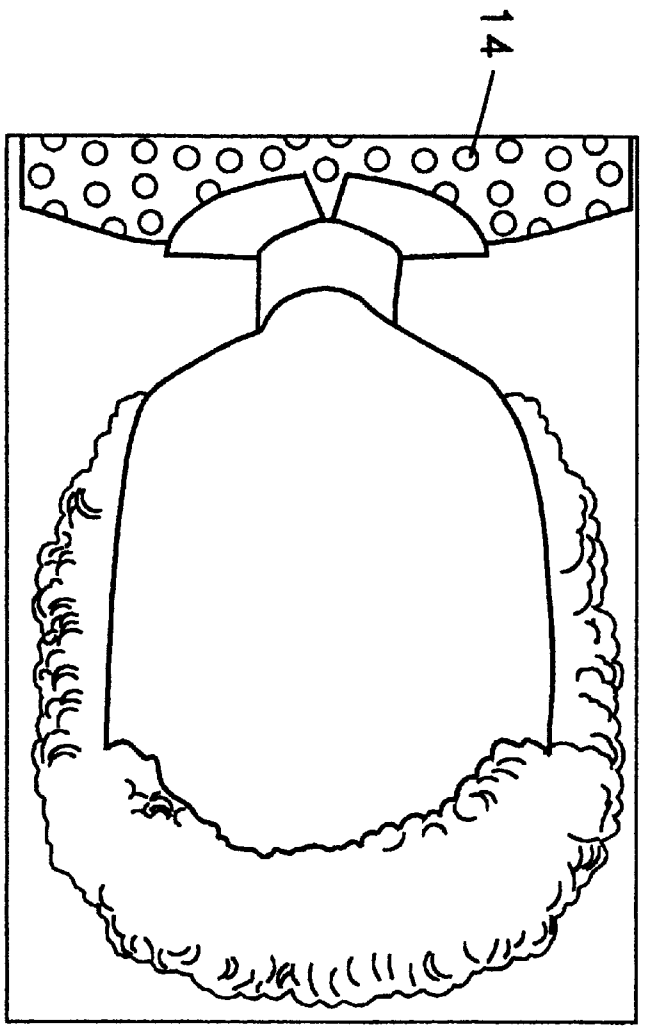
FIG. 7 is an overall image of a different funny face sheet, which also can be nested within a selected border frame in either of the casings of FIGS. 1A, 1B, and 2.
Figure 8:
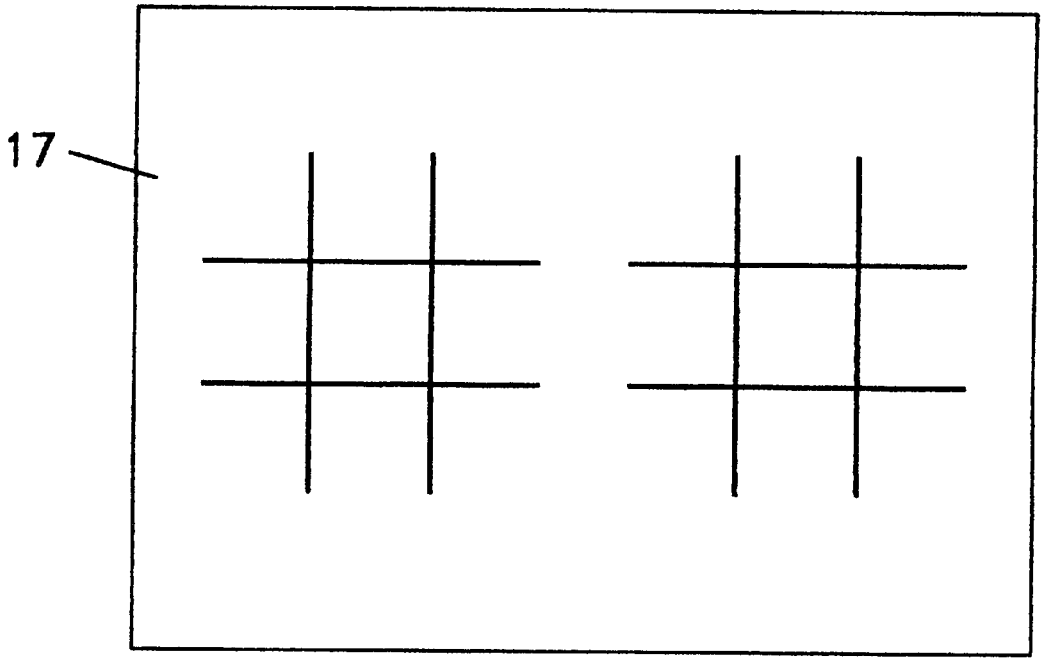
FIG. 8 is an overall visual image of an alternative "tic-tack-toe" frame sheet which also can be nested within a selected border frame in either of the casings of FIGS. 1A, 1B, and 2.
Figure 9:
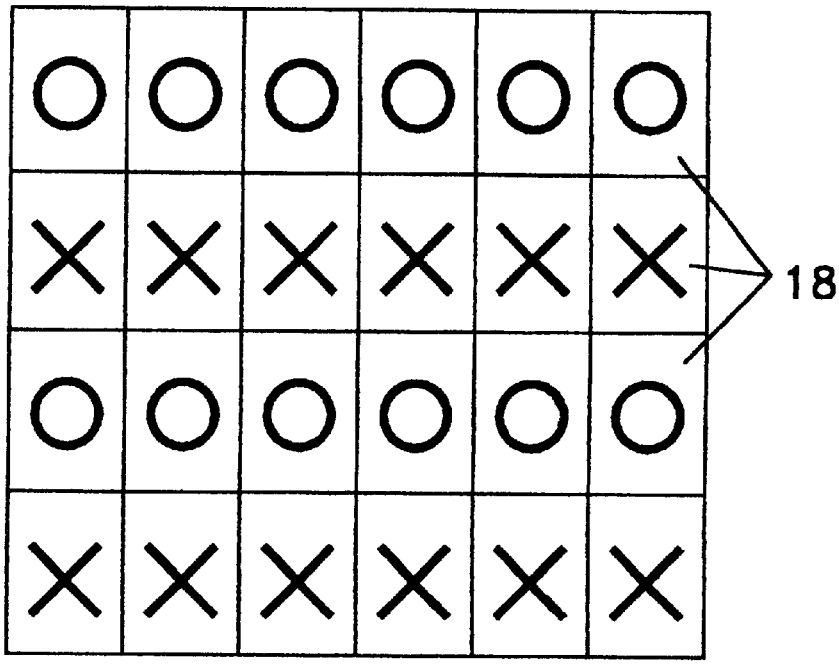
FIG. 9 is a flat, magnetically coated scored sheet of separable push-out naughts (O's) and crosses (X's) segments, which can be utilized with "tic-tack-toe" frames disclosed in FIG. 8.

The longer, opposed, corresponding and mating peripheral side edges 6 of each top and bottom lid 3 and 4 can be joined by suitably selected spaced wrapper hinges 8 (FIGS. 1B, 2 and 3). These wrapper hinges 8 are so designed as to allow for full flat opening of lids 3 and 4 so as to provide nesting or cradle sections—so that the flat panel sections 7, which are in spaced opposed relation when each casing 2 is open, can be aligned in a common, side-by-side, plane (FIG. 3). It is to be noted that the inner faces of flat panel sections 7, each include sheet retaining raised pairs of the entirety of spaced rectangular border frame forming members 9 (FIGS. 2 and 3). These raised border frame forming members 9, which can be stamp formed, are arranged to extend within, adjacent to, and parallel to the entirety of normally extending peripheral side edges 6. At least one of the border frame forming members 9 in each flat panel sections 7—advantageously that in top lid 3 (FIG. 3)—can be provided along the inner face thereof with opposed pairs of frame forming spaced indentations 11. Indentations 11 on the inner face of top lid flat panel section 7 serve to form sheet receiving border frame forming rectangularly shaped raises 12 (FIG. 1A) on the opposed outer face of panel section 7—in this case, the outer face of hinged, top cradle lid 3. As can be noted in FIGS. 1–3, the rectangularly forming, raised border frame forming members 9 are shaped to sufficiently accommodate and serve to nestingly receive and cradle in lodged position the entirety of the segments of one of three magnetically coated, scored sheets 13 (FIGS. 4 and 5), and one or more overall image changing sheets 14 (FIGS. 6–11 and 13). It is to be noted that the overall image changing sheet 14 of FIGS. 6 and 7, advantageously comprises a non-magnetic sheet of suitable paper with an alternative overall image coating of suitable colors thereon. The non-magnetic sheets 14, each of which presents a suitably marked overall image sheet, can be nested or cradled within a selected border frame 9. Magnetically coated scored sheets 13—(FIGS. 4A, 4B, 5A and 5B)—which are laminated with a suitable permanent magnetic coating 10 (FIGS. 4B and 5B) by any one of a number of magnetic coating processes not described herein—are each further coated with a plurality of scored, push-out image segments 16, designed to correspond with a portion of the selected overall image to which each can be magnetically fastened when pushed-out and removably freed from its magnetically coated scored sheet 13.

In summary, the border frame forming members 9 and 12, on top and bottom lids 3 and 4 can serve to receive at least one of three magnetically coated scored sheets 13 or the visual segments 16 thereof, each scored sheet 13 being sized and configured to nest or be cradled in the openable—closable hinged casing 2, with each magnetic coated scored sheet 13 including a plurality of selectively painted—or otherwise marked—push-out magnetic coated image segments 16 which can be push-out displaced to be movably and selectively magnetically fastened to one portion of the overall dolls or face images of the flat rectangularly shaped panel sections, each of which sections 7 itself can be painted or otherwise nestingly retain an overall image changing marked or painted sheet 14 within one of the border frame forming members 9 or 12. In this regard, it is again to be noted that the top faces of the casings 2 of FIGS. 1A, 1B and 2 are also each painted or otherwise coated with overall images. In FIGS. 1A, 1B and 2, a marked doll image is disclosed with spaced, marked, segments of spaced doll clothes surrounding the same in FIG. 1A. In FIG. 2, funny face markings are disclosed with marked segments of spaced face parts—such as eyes, ears, nose and mouth—to be mounted on the funny faces.

Other modified embodiments of the present invention can be seen in the drawings as disclosed in FIGS. 8–13. For example, in FIG. 8, an overall alternative visual image movable sheet 17 can be seen. This sheet 17 can be appropriately painted or marked with a number of "tic-tack-toe" frames. Each sheet 17, like aforedescribed sheet 14, can be nested or cradled in one of the border frame members 9 or 12. Then, separable push-out segments of naughts (O's) and crosses (X's) can be removably selected from the magnetically coated scored segmental sheet 18 (FIG. 9) and one or more "tic-tack-toe" games can be played by a game user by selectively fastening the segments from sheet 19 to one of the aforedescribed "tic-tack-toe" frames on alternative overall visual image sheet.

Figure 10:
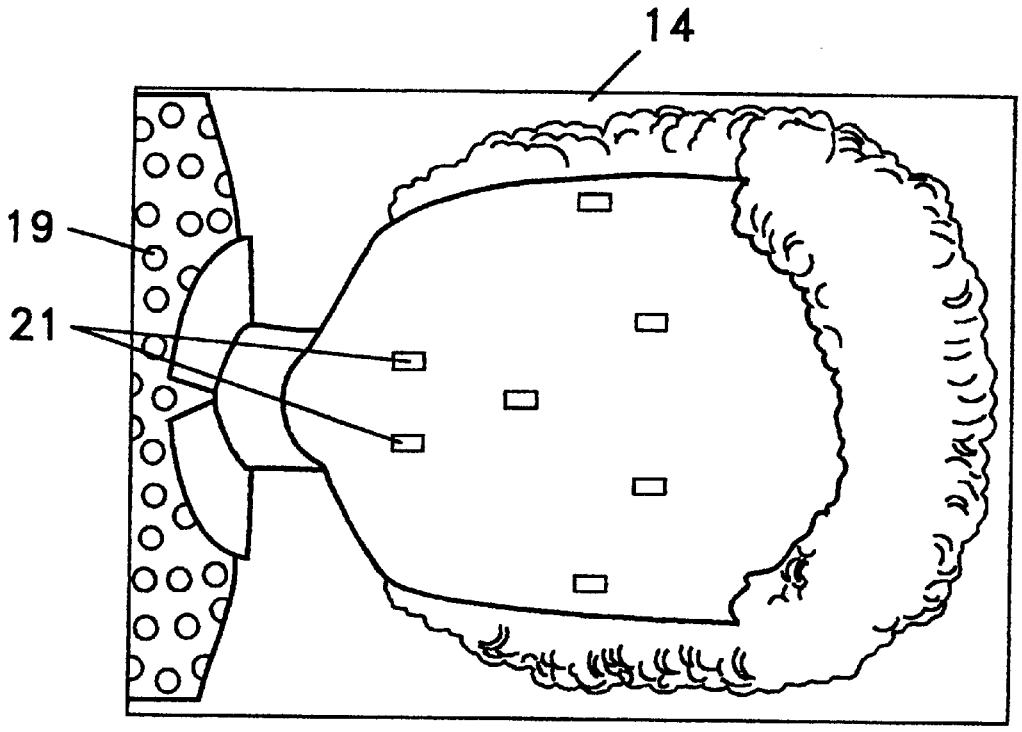
FIG. 10 is an overall image of still a different play doll sheet which can be nested within a selected border frame in either of the casings of FIGS. 1A, 1B, and 2, the several segmental portions of the play doll image each being provided with an adhesive "hook and looped" strip type tape; and, FIG. 11 is the rear side of a scored sheet of separable push-out segments, each segment being provided with an adhesive "hook and loop" strip tape positioned to face and fasten to the "hook and looped" strip type tape of the corresponding segmental portion of the play doll of FIG. 10.
Figure 11:
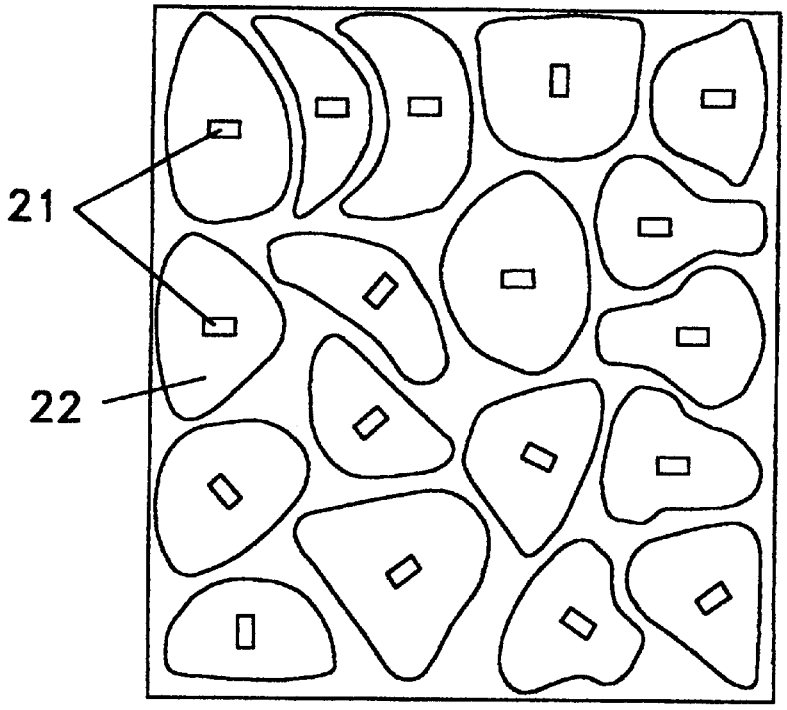

In FIGS. 10 and 11, a still further modification of the present invention can be seen. In this modification, a painted or coated overall visual image sheet 19 is shown with a play doll with selected painted portions each being provided with an adhesive "hook and looped strip" ("Velcro™") type tape 21. In FIG. 11, the back of scored push-out segmental sheet 22 is disclosed with each push-out segment also being provided with "hook and loop strip" type tape 21. In a fashion similar to the aforedescribed magnetic fastening arrangement, the segments from scored sheet 22 can be pushed-out by a game user and fastened appropriately to the tapes 21 on overall visual image sheet 19 which can be nested in one of the border frames 9 or 12. It is to be understood, that as a further modification of the present invention, in place of the "hook and looped" strips 21 on sheets 19 and 22 an appropriate releasable adhesive can be employed with the scored sheet 22 to fasten the segments to the appropriately border frame cradled overall image. Further, it is to be understood that even slot and tab arrangements can be utilized as fastening means in the present invention.

Figure 12:
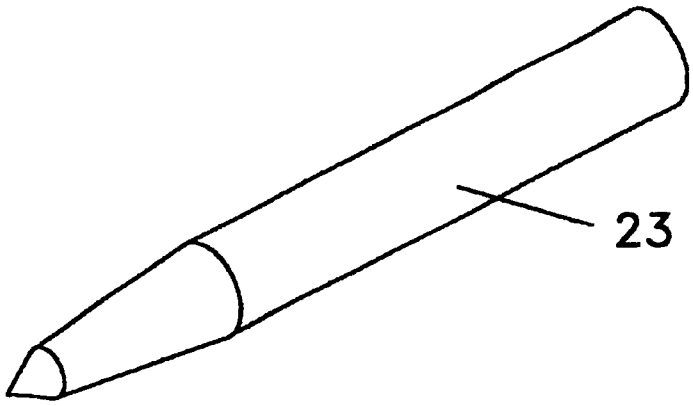
FIG. 12 is a marker pen which can be used to develop selected invisible portions of a portion of a sheet which has been selectively treated with invisible ink; and, FIG. 13 is a segmental sheet, a portion of the segments being in invisible ink to be developed by the marker pen.
Figure 13:
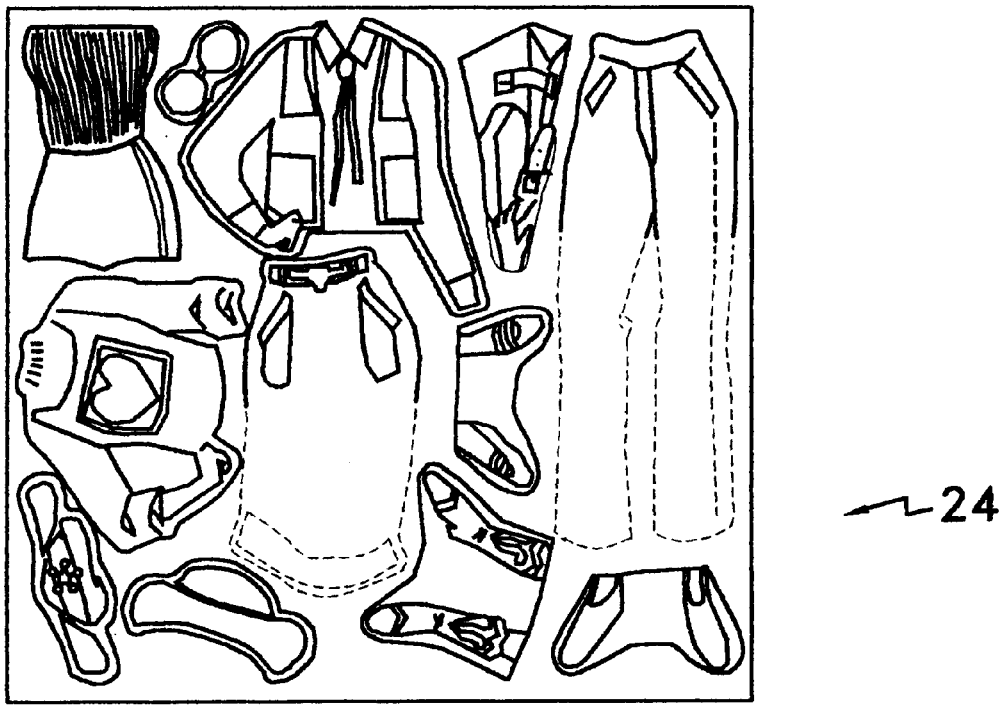

Finally, in FIGS. 12 and 13, even a further modification of the novel game can be seen, wherein an invisible ink marking pen 23 (FIG. 12) can be used to develop one of the apparently uncoated push-out segments shown in dotted lines on push-out scored segment sheet 24.

The invention claimed is:

1. A game comprising:

an openable-closable casing having mating top and bottom sections; said top and bottom sections each including inner and outer faces and opposed surrounding mating peripheral edges; the top and bottom sections being moveable between a closed position and a fully opened position in which the top and bottom sections lie in a common plane;

at least one changeable visual image sheets, said changeable visual image sheet having an overall visual image printed thereon;

at least one of said top and bottom sections including sheet retaining raised, opposed border members extending along one face of said section within and along the peripheral edge of said one section to nestingly receive and cradle said at least one changeable visual image sheets with said sheet being sized and shaped to be retained within said border members;

at least one movable game segment sized to be removably disposable in said fully openable-closable casing to overlie at least a portion of said changeable visual image sheet, said movable game segment including an adheringly responsive fastening member to be movably held in fastened overlying relation with said changeable visual image sheet.

2. The game of claim 1, wherein at least one of said opposed border members of one of said top and bottom sections has a plurality of spaced indentations along one of said faces of said section extending adjacent said border members to form opposed sheet receiving raises forming a nesting cradle border forming member along said opposite face of said section.

3. The game of claim 1, at least one of said opposed peripheral edges thereof having hook receiving means to receive in fastened relation therewith the body of a suspending hook member to suspend said game from a marketing display rack.

4. The game of claim 1, said openable-closable casing being in the shape of a substantially flat, longitudinally extending, rectangular box sized to accommodate said at least one changeable image sheet and said at least one moveable game segment.

5. A game comprising:

an openable-closable casing having mating top and bottom sections; said top and bottom sections each including a panel having inner and outer faces and opposed surrounding mating peripheral sides extending from said panel; said casing being movable between a closed position in which said casing defines an enclosed volume and a fully opened position in which the top and bottom sections can lie in a common plane; said openable-closable casing being of magnetically responsive material;

at least one changeable image sheet having a visual image thereon; said visual image sheet being contained in said enclosed volume when said casing is closed; said openable-closable casing being in the shape of a substantially flat, longitudinally extending, rectangular box sized to accommodate said at least one changeable image sheet; at least one of said top and bottom sections having at least one border shaped to cradle said at least one changeable image sheet within said border; and at least one moveable game segment sheet; said game segment sheet comprising a magnetic scored coated sheet of material sized and configured to nest in said openable-closable casing; each scored sheet including a plurality of push-out magnetic coated game segments to be displaced from said game segment sheet to be moveably and selectively fastened to said visual image to overlie at least a portion of said changeable visual image sheet within said border, said movable game segment including an adheringly responsive fastening member to be movably held in fastened overlying relation with said changeable visual image sheet.

6. The game of claim 5, said fastening means comprises a "hooked and looped" strip type adhesive.

7. The game of claim 5, wherein there are at least two separate movable game segments, each of said game segments being removably disposable in said fully openable and fully closable casing; each game segment including a magnetically responsive fastening means to be movably held in fastened, overlying relation with at least a portion of said changeable visual image sheet.

8. The game of claim 5, said visual image initially being in invisible form to be developed by a marking instrument.

9. The game of claim 5, wherein at least one face of at least one of said top and bottom sections includes said visual image thereon in selected colors.

10. The game of claim 5, said visual image being in the form of a play doll and said push-out segments being in the form of doll clothes.

11. The game of claim 5, said visual image being in the outline form of a face and said push-out segments being in the form of face parts.

12. The game of claim 5, said visual image being in the form of a "tic-tack-toe" frame and said push-out segments being in the form of naughts (0's) and crosses (X's).

13. The game of claim 5, said adheringly responsive fastening members are of a magnetically active and responsive type with said portion of said casing and said movable segment incorporating fastening magnetic and magnetic responsive materials respectively.

14. A game comprising an openable-closing firm casing including a pair of magnetically responsive mating top and bottom nesting cradle sections; said nesting cradle sections each including pairs of spaced opposed mating peripheral side edges integral with and extending normally from flat panel sections; one mating corresponding peripheral side edge of each top and bottom cradle section being hingedly joined allowing for flat opening of the nesting cradle sections to be substantially aligned with said flat panel sections, each flat panel section including opposed inner and outer faces in substantial side-by-side relationship when said cradle sections are in open position, said inner faces of said flat panel sections each including sheet retaining raised pairs of spaced border members extending along said pairs of spaced peripheral side edges of said cradle section and at least one having pairs of spaced indentations extending adjacent said border members to form sheet receiving nesting border members along said opposite face thereof, said border members serving to receive at least one coated scored sheet of material, said sheet being sized and configured to nest in said openable-closable hinged casing and including a plurality of push-out magnetic coated game segments to be displaced from said sheet and moveably and selectively fastened to one portion of said faces of said flat panel sections within one of said border members; at least one of said flat sections having a visual image in selected colors within said border members to receive in magnetically fastened relation thereto a selectively colored push-out magnetic coated game segment movably and selectively fastened thereto; and, at least one changeable sheet of different visual images also sized to nest in said openable-closable hinged casing within one of said raised border members on one of said flat panel sections to provide a change of visual images within one of said border members of said flat panel sections.

15. The game of claim 14, at least one of said visual images being in the form of a play doll with said corresponding push-out parts being in the form of doll clothes.

16. The game of claim 14, at least one of said visual images being in the outline form of a face with said corresponding push-out parts being in the form of face parts.

17. The game of claim 14, said visual image being in the form of a preselected frame and said corresponding parts being in the form of selective parts to complete said frame.

* * * * *